US008371614B2

(12) United States Patent
Rodriguez

(10) Patent No.: US 8,371,614 B2
(45) Date of Patent: Feb. 12, 2013

(54) SKI-POLE COUPLING ASSEMBLY

(76) Inventor: Joseph Judethaddeus Rodriguez, Lockport, NY (US)

( * ) Notice: Subject to any disclaimer, the term of this patent is extended or adjusted under 35 U.S.C. 154(b) by 417 days.

(21) Appl. No.: 12/789,789

(22) Filed: May 28, 2010

(65) Prior Publication Data

US 2011/0291397 A1 Dec. 1, 2011

(51) Int. Cl.
*A63C 11/00* (2006.01)

(52) U.S. Cl. ..... 280/814; 280/809

(58) Field of Classification Search ..... 280/60–602, 280/609, 809, 812–815, 817–820
See application file for complete search history.

(56) References Cited

U.S. PATENT DOCUMENTS

| | | | | | |
|---|---|---|---|---|---|
| 3,564,667 | A | * | 2/1971 | Parrick, III et al. | 280/814 |
| 3,626,553 | A | * | 12/1971 | Darney et al. | 280/814 |
| 3,889,861 | A | * | 6/1975 | Fihn | 294/147 |
| 3,893,606 | A | * | 7/1975 | Hofmann | 224/309 |
| 3,910,593 | A | * | 10/1975 | Schwarz | 280/817 |
| 3,951,421 | A | * | 4/1976 | Brangenberg | 280/817 |
| 3,951,425 | A | * | 4/1976 | Lohr | 280/817 |
| 4,002,349 | A | * | 1/1977 | Dopp | 280/814 |
| 4,006,911 | A | * | 2/1977 | Kraus et al. | 280/809 |
| 4,059,208 | A | * | 11/1977 | Koepcke | 280/814 |
| 4,134,182 | A | * | 1/1979 | Ramsby | 280/814 |
| 4,175,683 | A | * | 11/1979 | Shields | 280/814 |
| D253,857 | S | * | 1/1980 | Thompson | D3/259 |
| 4,278,192 | A | * | 7/1981 | Sazegar | 224/315 |
| 4,494,787 | A | * | 1/1985 | Gainey | 294/147 |
| 4,620,722 | A | * | 11/1986 | Dunn | 280/814 |
| 4,630,842 | A | * | 12/1986 | Roda | 280/814 |
| 4,702,495 | A | * | 10/1987 | Roda | 280/814 |
| 4,786,097 | A | * | 11/1988 | Howard | 294/147 |
| 5,094,479 | A | * | 3/1992 | Shields | 280/814 |
| 5,141,251 | A | * | 8/1992 | Smith | 280/814 |
| 5,282,535 | A | * | 2/1994 | Rowland | 206/315.1 |
| 5,433,930 | A | * | 7/1995 | Taschner | 422/300 |
| D443,201 | S | * | 6/2001 | Bendick | D8/394 |
| 6,430,782 | B1 | * | 8/2002 | Torres et al. | 24/3.1 |
| 7,273,233 | B2 | * | 9/2007 | Möller | 280/814 |
| 7,490,858 | B1 | * | 2/2009 | Sellers et al. | 280/814 |
| 7,798,528 | B2 | * | 9/2010 | Sellers et al. | 280/814 |
| 2004/0124626 | A1 | * | 7/2004 | Kraabel | 280/809 |
| 2005/0236830 | A1 | * | 10/2005 | Moller | 280/814 |
| 2007/0222168 | A1 | * | 9/2007 | Sellers et al. | 280/79.7 |
| 2009/0039231 | A1 | * | 2/2009 | McLaughlin | 248/535 |
| 2009/0230667 | A1 | * | 9/2009 | Starry | 280/814 |
| 2011/0303712 | A1 | * | 12/2011 | Calamia et al. | 224/401 |

* cited by examiner

*Primary Examiner* — J. Allen Shriver, II
*Assistant Examiner* — Travis Coolman
(74) *Attorney, Agent, or Firm* — Vincent G. Lotempio; Kloss, Stenger & LoTempio

(57) ABSTRACT

The current disclosure presents a ski-pole coupling assembly wherein the attachment point is permanently housed on the ski, does not interfere with skiing activity, and does not become impaired by ice and snow. The current disclosure has a pair of brackets on each ski placed proximate the ski bindings. The brackets are of such height that, when placed on the brackets, the poles are not hindered by the bindings. The poles are removably affixed to the brackets by a flexible securing member, attached to the brackets. The securing members could be attached to the brackets by a number of different methods, such as by snaps, clips, rivets, etc. or a combination thereof.

8 Claims, 3 Drawing Sheets

SKI-POLE COUPLING ASSEMBLY

FIELD OF THE INVENTION

The present disclosure relates to snow skis, and in particular to an accessory that mounts onto a ski, allowing for a ski pole to be attached.

BACKGROUND OF THE INVENTION

Carrying skis, poles, and other equipment is awkward and difficult for many skiers. For most skiers, transporting gear requires the skier to carry skis in one hand, poles in the other hand, and any other equipment placed in a bag carried over the shoulder. Adding to this difficulty is the fact that skis and poles are long, heavy, and have sharp edges and points. A number of devices have been developed to aid skiers in carrying the skis and poles. However, when the skis are being worn, these devices must be carried on the skier's person and tend to be bulky and impede the skier's enjoyment of the slopes. Other devices have been developed which are permanently attached to the skis or poles. However, these permanent attachments are expensive and do not function properly as the devices become packed with ice and snow during skiing activities.

Several devices have been invented which have attempted to solve the problem of attaching ski poles to skis. For example, U.S. Pat. No. 4,630,842 issued to Roda discloses a method and apparatus for carrying snow skis. In this method, a receiver is mounted onto a ski and functions to receive the tip of a ski pole. The receiver is mounted in such a way that, when a pole is inserted, the pole is perpendicular to the skis, thereby allowing the pole to be placed over the shoulder of an individual for carrying the skis. This perpendicular setup, however, only allows for one method of carrying the skis, namely, over the shoulder. It would be very awkward for the user if they wanted to carry the skis any other way, for example, with their hands at their side. The perpendicular setup is also not conducive for storage of the poles and skis together, as this setup takes up a lot of space. Also, there are disadvantages to the method of mounting the pole to the ski by the pole tips. For one, this is not a very secure method. If anything were to disturb the skis while carrying over the shoulder, they would fall off the end of the pole. Another disadvantage is that this design does not accommodate ski tips of varying diameter, so there may be instances where the mount is too tight or too loose to work properly.

U.S. Pat. No. 7,273,233 issued to Moller and Moller discloses a ski clip that mounts onto a ski pole, and allows the pole to be clamped onto a ski. There are numerous disadvantages to this design. For one, if anything was to move the ski pole while attached to the ski, the user runs the risk of damaging the surface of the ski. Also, this device mounts onto the ski pole, and not the ski. This not only increases the weight of the ski pole, but also does not account for varying diameters of ski poles. In addition, this method of securing the pole to the ski by a clip on only one end of the ski is not very secure. The ski pole could not be used as a handle to carry the ski. The clamping pressure of the clip will wear out over time. Another disadvantage to this design is that it contains moving parts, namely, the pivot the clip is attached to. This can cause the clip to easily break off during a fall if left open, and become loose and rusty over time.

U.S. Patent Application No. 20090230667 from inventor Starry discloses an integrated pole-to-ski coupling assembly. This system allows for multiple different pole and ski coupling formations, by preferably using attachments both on the ski pole and ski bindings. This system does securely attach the pole horizontally along the ski and allows for the ski pole to be used as a handle. However, the greatest disadvantage to this design regards its complicated nature. This disclosure requires parts to be mounted both on the ski pole and the ski. Also required are either ski bindings that are capable of receiving the coupling or special attachments that allow this. These multiple parts and part combinations greatly increase the cost of such an assembly. Another disadvantage of this design is that it mounts the ski poles in a specific, non-adjustable position onto the ski. A user is not given the choice to mount the ski pole towards the rear end or right in the middle of the ski if they choose. In addition, since this system requires a device mounted onto the ski pole itself, it does not accommodate users of different sets of poles without the purchase of additional parts, such as when a user forgets his/her poles and needs to rent or borrow another pair, nor does it accommodate ski rental locations, where varying combinations of skis, poles, and bindings are used.

In one embodiment of the Starry invention, a coupling is attached to the ski beyond the bindings. However, in this instance, only a single coupling is attached to the ski, and the nature of the coupling combination is no less cumbersome or complex than the other Starry embodiments, requiring parts mounted to the ski pole and a separate base mounted to the ski (i.e. two couplings per point of attachment). The coupling connections are also designed in such a manner as they are easily impeded by ice and snow (they contain small holes that serve as connection points). As such, this disclosure fails to solve the stated problems of simplicity of design, cost-effectiveness, versatility, and snow/ice impedance.

Thus it is readily apparent that there is a long felt need for a single ski-pole coupling assembly that satisfies the following conditions, such as: 1) the ski-pole coupling assembly attaches a ski pole to a ski for ease of carrying, transportation, and storage; 2) the ski-pole coupling assembly permanently attaches to the ski so as to not impede the skier when not in use; 3) the ski-pole coupling assembly is simply designed for maximum versatility for use on all skis and poles; 4) the ski-pole coupling assembly is fast and easy to use; 5) the ski-pole coupling assembly is inexpensive; 6) and the ski-pole coupling assembly functions so as to not get impeded by ice or snow. The present disclosure satisfies the above-mentioned needs, as well as others, and overcomes the deficiencies in devices heretofore developed.

SUMMARY OF THE INVENTION

The current disclosure presents a ski-pole coupling assembly wherein the attachment point is permanently housed on the ski, does not interfere with skiing activity, and does not become impaired by ice and snow. The current disclosure comprises a pair of inverted, generally U-shaped brackets on each ski placed proximate the ski bindings. The brackets are of such height that, when placed on the brackets, the poles are not hindered by the bindings. The poles are removably affixed to the brackets by a flexible securing member attached to the brackets. The securing members could be attached to the brackets by a number of different methods, such as by snaps, clips, rivets, etc. or a combination thereof.

It is a general object of the present disclosure to attach a pole to a ski in such a way that facilitates storage, carrying, and transportation.

It is another object of the present disclosure to permanently attach to the ski so as to not impede the skier when not in use, and to not impede use of ski poles while skiing;

It is still another object of the present disclosure to be simply and universally designed, allowing for its use with virtually any ski and ski pole combination;

It is another object of the present disclosure to be fast and easy to use, allowing the user to quickly mount the ski pole in any position along the length of the ski (i.e. towards the front, back, or right in the middle);

It is a further object of the present disclosure to be small and have a limited number of parts, allowing for it to be cost-effective;

It is still another object of the present disclosure to be designed with no small holes or complex coupling assemblies that could be impeded by ice or snow.

These and other objects, features and advantages of the present disclosure will become readily apparent to those having ordinary skill in the art upon a reading of the following detailed description in view of the appended claims and drawings.

BRIEF DESCRIPTION OF THE DRAWINGS

The disclosure is explained below by means of schematic drawings (see attached) and with additional details. The drawings include.

DETAILED DESCRIPTION OF THE INVENTION

Description of Ski-Pole Coupling Assembly Drawings

Figure 1:
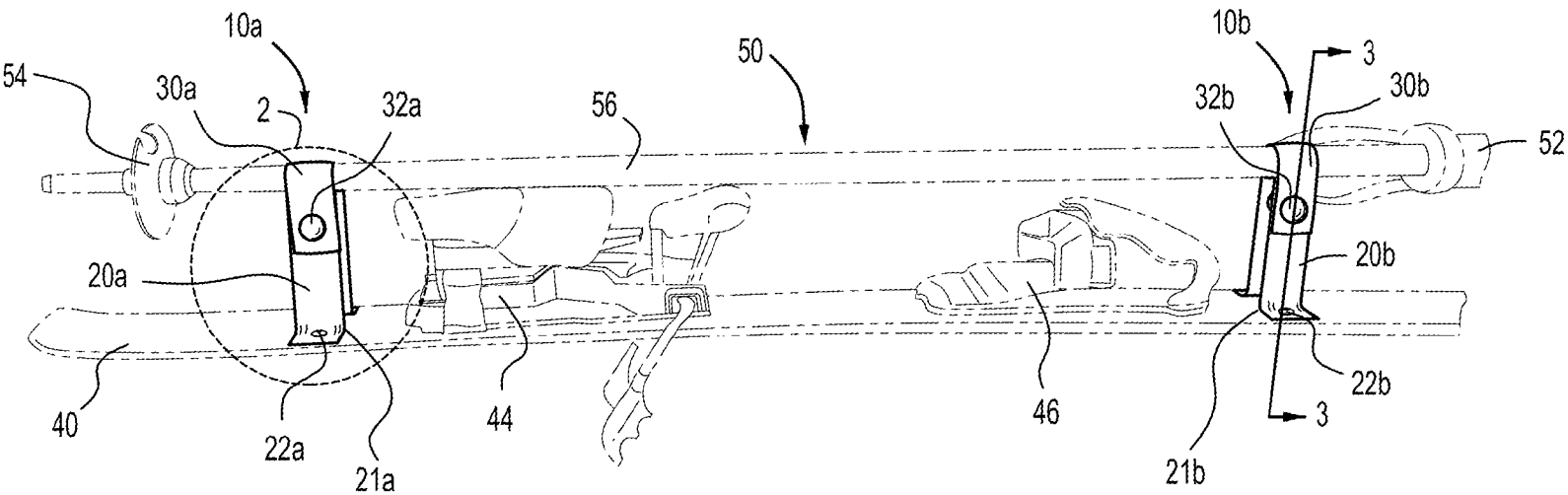
FIG. 1 is a side perspective view of a single ski with ski pole attached, using the ski-pole coupling assembly according to the disclosure.

At the outset, it should be clearly understood that like reference numerals are intended to identify the same structural elements, portions, or surfaces consistently throughout the several drawing FIGS., as may be further described or explained by the entire written specification of which this detailed description is an integral part. The drawings are intended to be read together with the specification and are to be construed as a portion of the entire "written description" of this invention as required by 35 U.S.C. §112.

In the preferred embodiment of the disclosure, the ski-pole coupling assembly is meant to be used by a snow skier using two skis and two poles. Skis ordinarily are comprised of flat, rigid body members, with bindings placed on the surface of the body members for attaching ski boots. Carrying skis, poles, and other equipment to and from the ski slopes is awkward and difficult for many skiers. For most skiers, transporting gear requires the skier to carry skis in one hand, poles in the other hand, and any other equipment placed in a bag carried over the shoulder. Employing the current bracket system allows the skier to carry both skis and poles in one hand.

Averting now to the drawings, with reference to FIG. 1, a preferred embodiment of the disclosure is generally indicated by numerals 10*a* and 10*b*. In the preferred embodiment, two brackets with securing members are mounted onto each ski, juxtaposed proximate the ski bindings so as to receive a ski pole, comprising a total of four brackets with securing members for each ski-pole coupling assembly. Each single bracket with securing member is identical to the other three brackets with securing members integrated in the ski-pole coupling assembly. FIG. 1 illustrates ski 40 with attached bindings 44, 46. Ski pole 50 is shown comprising a handle 52, tip 54, and shaft 56. Ski 40 is shown with ski pole 50 removably attached to brackets 30*a*, 30*b* by securing members 32*a*, 32*b*. Securing members 30*a*, 30*b* are shown affixed to brackets 20*a*, 20*b* by snap enclosures 32*a*, 32*b*', said snap enclosures 32*a*, 32*b* operable to releasably affix securing members 30*a*, 30*b* to the bracket. Using snap enclosures 32*a*, 32*b* is a preferred embodiment because the snap is easily secured when placing the ski pole onto the bracket, the snap securely holds the ski pole during transport, and the snap is easily released when removing the ski pole from the bracket. Having snap enclosures 32*a*, 32*b* on each side of brackets 20*a*, 20*b* allows the user the flexibility to release ski pole 50 from either side of bracket 20*a*, 20*b*. Other embodiments of the disclosure use enclosure devices that are also strong enough to hold ski pole 50 in place during transportation, and operable to easily release pole 50, such as Velcro or adjustable clips. Still other embodiments fixedly attach one side of the enclosure device, such as through a rivet or other securing means. Although the flexibility of releasing ski pole 50 from either side of brackets 20*a*, 20*b* is lost, by fixedly attaching one side of the enclosure device, the loss of securing members 32*a*, 32*b* is prevented. Brackets 20*a*, 20*b* are shown permanently mounted onto ski 40 using screws 22*a*, 22*b*. In other embodiments of the disclosure, brackets 20*a*, 20*b* are mounted to ski 40 in any number of different ways, including by glue or rivets. In the preferred embodiment as illustrated, brackets 20*a*, 20*b* are juxtaposed onto ski 40 proximate the front 46 and rear 44 ski bindings, and are operatively arranged to receive ski pole 50 along shaft 56 between ski pole handle 52 and ski pole tip 54. It should be readily apparent to those with ordinary skill in the art that brackets 20*a*, 20*b* may be operatively arranged in other embodiments to receive ski pole 50 at handle 52 and shaft 56, or at tip 54 and shaft 56, or at handle 52 and tip 56. Brackets 20*a*, 20*b* are positioned so that ski pole 50 clears bindings 44 and 46. The brackets are attached to ski 40 through an attachment point in generally L-shaped base members 21*a*, 21*b* of brackets 20*a*, 20*b*. Generally L-shaped base members 21*a*, 21*b* extend outwardly from the base of the brackets at an approximate 90-degree angle. Brackets 20*a*, 20*b* are preferably made of solid cast aluminum or other similar metal that is light and waterproof, but could be made of any lightweight and waterproof material, such as plastic or fiberglass. Securing members 30*a*, 30*b* are preferably made of nylon, but could also be composed of any strong, flexible material, or rigid material molded to the shape of ski pole 50. One could also use an elastic material, which would allow securing members 30*a*, 30*b* to close tight to brackets 20*a*, 20*b* when no ski pole 50 is attached, with enough elasticity to allow ski pole 50 to fit within the enclosure and still be easily closed. With ski pole 50 attached as shown, ski pole 50 can be either used as a handle in which to carry ski 40, or can be used to simply free ski pole 50 from the hands of the user.

Figure 2:
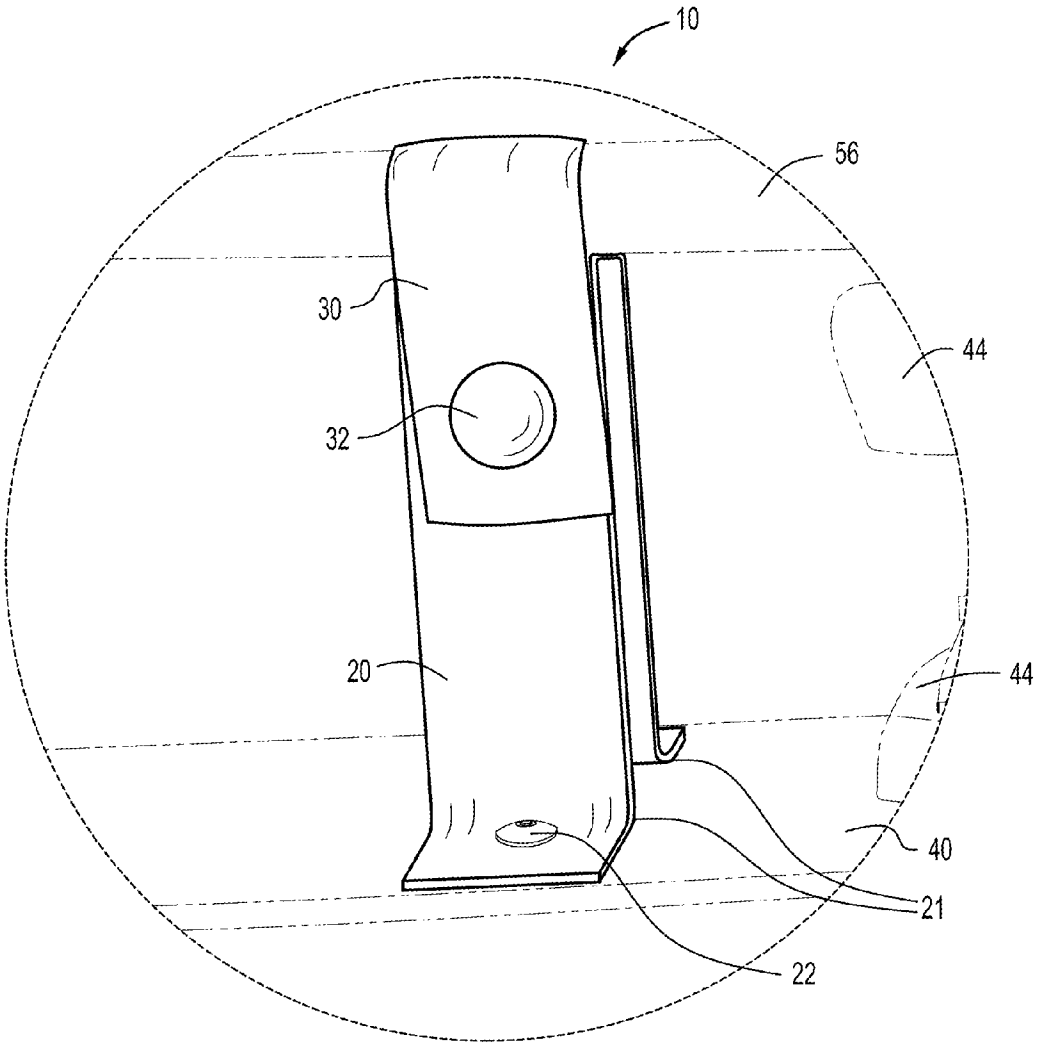
FIG. 2 is a magnified view of a rear ski-pole coupling assembly with ski pole attached, taken generally along circle 2 of FIG. 1.

FIG. 2 illustrates a magnified view of a ski-pole coupling assembly, generally shown in circle 2 of FIG. 1 as numeral 10. The magnified view illustrates bracket 20 proximate to rear binding 44 of ski 40. FIG. 2 clearly shows how bracket 20 is attached to ski 40 by screws 22 through an attachment point in generally L-shaped base members 21 of bracket 20. Ski-pole shaft 56 is held to bracket 20 by securing member 30 and snap enclosure 32. As noted above, additional embodiments of the disclosure are envisioned with securing member 30 attached to bracket 20 by one or more rivets, Velcro attachments, clips, etc.

Figure 3:
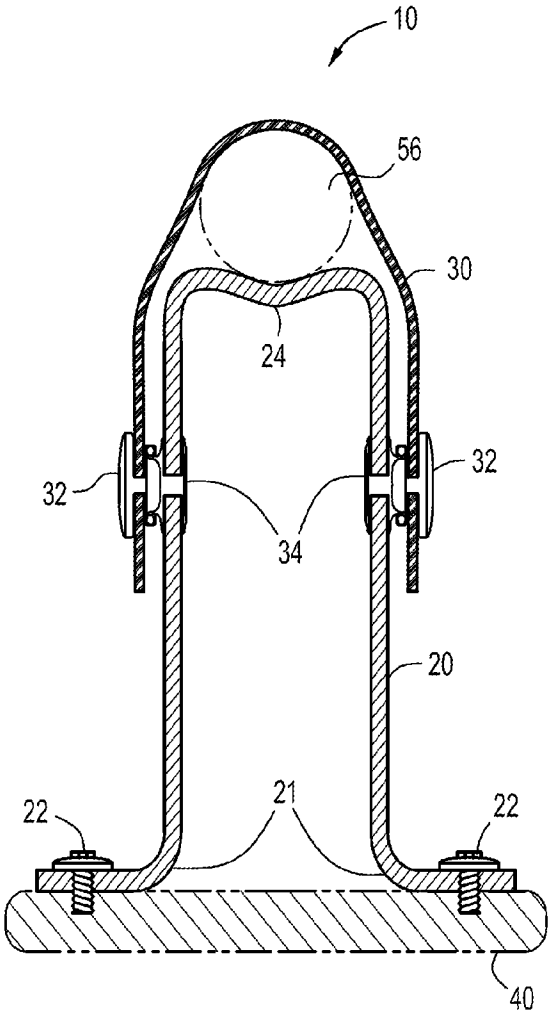
FIG. 3 is a cross-sectional view of a ski-pole coupling assembly according to the disclosure, with ski pole attached, taken generally along line 3-3 of FIG. 1.

FIG. 3 is a cross-sectional view of a ski-pole coupling assembly 10 according to the disclosure, with ski pole shaft 56 attached, taken generally along line 3-3 of FIG. 1. FIG. 3 illustrates bracket 20 attached to ski 40 by screws 22 through attachment points at the L-shaped base members 21 of bracket 20. Securing member 30 is attached to bracket 20 through snap enclosures 32, 34 on either side of bracket 20. This allows for the removable attachment of ski pole shaft 56 from either side of bracket 20. The present embodiment illustrates the female end of snap enclosure 32 as attached to securing member 30, with the male end of snap enclosure 34 attached to bracket 20. Another embodiment not shown in the drawings has the ends of the snap enclosures reversed, with male end 34 attached to securing member 30 and female end 32 attached to bracket 20. A further embodiment of the disclosure has an adjustable snap enclosure. The adjustable enclosure would accommodate ski pole shafts 56 of varying diameter, as well as allow for a tight connection of securing member 30 to bracket 20 when no ski pole shaft 56 is attached. Another preferred embodiment has a securing means other than snap enclosure 32, 34, such as Velcro or adjustable clips. The top of bracket 20 is shown in this embodiment to have concave surface 24 for receiving ski pole 50. The arcuate shape allows ski pole shaft 56 to be removably attached to the top of bracket 20 by securely mating with the curve of ski pole shaft 56 having a convex surface.

Figure 4:
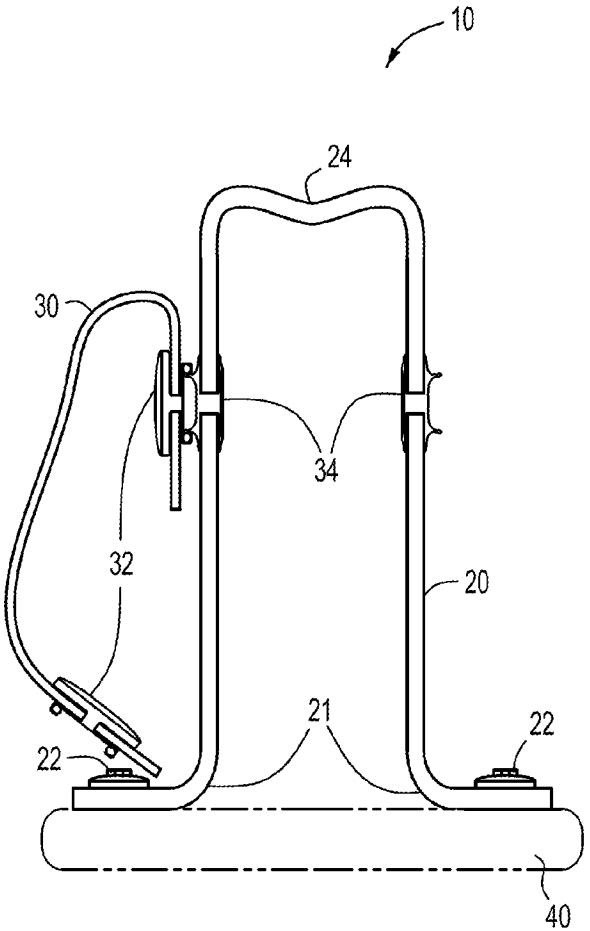
FIG. 4 is a side view looking away from the bindings of a ski-pole coupling assembly according to the disclosure, with securing member opened and no pole attached.

FIG. 4 is a side view looking away from the bindings of a ski-pole coupling assembly 10 according to the disclosure, with securing member 30 opened and no pole attached. FIG. 4 illustrates bracket 20 attached to ski 40 by screws 22 through an attachment point at generally L-shaped base members 21 of bracket 20. Concave surface 24 is shown on bracket 20, suitable for mating with the curve of a ski pole (not shown). Securing member 30 is shown with one snap enclosure 32, 34 unattached and with the other snap enclosure 32, 34 attached. As illustrated in this embodiment, ski-pole coupling assembly 10 may receive a ski pole (see FIG. 3), or unattached snap enclosure 32, 34 may be reattached with no ski pole, or securing member 30 may be removed completely.

While a preferred form of this disclosure has been described above and shown in the accompanying drawings, it should be understood that applicant does not intend to be limited to the particular details described above and illustrated in the accompanying drawings, but intends to be limited only to the scope of the invention as defined by the following claims. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A ski-pole coupling assembly comprising: a pair of inverted, generally U-shaped brackets for removably affixing a ski pole to a ski, each bracket fixedly attached to said ski, wherein said brackets are operatively arranged to removably receive said ski pole horizontally along the length of said ski, and a means for removably securing said ski pole to said pair of inverted, generally U-shaped brackets, wherein the means for removably securing is a flexible securing member removably attached to said bracket, and wherein the flexible securing member is removably attached to the inverted, generally U-shaped bracket by at least one snap closure.

2. The ski-pole coupling assembly of claim 1, wherein the inverted, generally U-shaped brackets are an integral part of the ski.

3. The ski-pole coupling assembly of claim 1, wherein the inverted, generally U-shaped brackets have a concave surface, operative to mate with said ski pole having a convex surface.

4. The ski-pole coupling assembly of claim 1, wherein the inverted, generally U-shaped brackets have generally L-shaped base members for fixedly attaching the brackets to the ski.

5. The ski-pole coupling assembly of claim 1, wherein said skis are skis with attached bindings, and wherein said inverted, generally U-shaped brackets are operatively placed proximate said bindings so that said bindings are unaffected when the ski pole is attached.

6. The ski-pole coupling assembly of claim 1, wherein the flexible securing member is attached to the inverted, generally U-shaped bracket by one rivet and one snap closure.

7. A ski-pole coupling assembly comprising: a pair of inverted, generally U-shaped brackets for removably affixing a ski pole to a ski, each bracket fixedly attached to said ski, each bracket having a concave surface, operative to mate with said ski pole having a convex surface, wherein said brackets are operatively arranged to removably receive said ski pole horizontally along the length of said ski, and having a flexible securing member removably attached to said bracket for removably securing said ski pole to said pair of inverted, generally U-shaped brackets, wherein the flexible securing member is attached to the inverted, generally U-shaped bracket by one rivet and one snap closure, and wherein the inverted, generally U-shaped brackets have generally L-shaped base members for fixedly attaching the brackets to the ski, and wherein said skis are skis with attached bindings, and wherein said inverted, generally U-shaped brackets are operatively placed proximate said bindings so that said bindings are unaffected when the ski pole is attached.

8. The ski-pole coupling assembly of claim 7, wherein said rivet is a snap closure.

* * * * *